US010769949B2

(12) United States Patent
Edwards et al.

(10) Patent No.: US 10,769,949 B2
(45) Date of Patent: Sep. 8, 2020

(54) PARKING FACILITATION SYSTEMS AND METHODS

(71) Applicant: TOYOTA MOTOR NORTH AMERICA, INC., Plano, TX (US)

(72) Inventors: Michael C. Edwards, Plano, TX (US); Randall M. Harris, Plano, TX (US); Nutonya L. Parker, Plano, TX (US); Ashok Ramadass, Plano, TX (US); Kotaro Hashimoto, Frisco, TX (US); James H. Kikuma, Plano, TX (US)

(73) Assignee: TOYOTA MOTOR NORTH AMERICA, INC., Plano, TX (US)

( * ) Notice: Subject to any disclaimer, the term of this patent is extended or adjusted under 35 U.S.C. 154(b) by 0 days.

(21) Appl. No.: 16/226,602

(22) Filed: Dec. 19, 2018

(65) Prior Publication Data

US 2020/0202716 A1 Jun. 25, 2020

(51) Int. Cl.

| | |
|---|---|
| ***G08G 1/14*** | (2006.01) |
| ***G08G 1/0968*** | (2006.01) |
| ***G08G 1/01*** | (2006.01) |

(52) U.S. Cl.

CPC ..... *G08G 1/143* (2013.01); *G08G 1/0108* (2013.01); *G08G 1/096855* (2013.01); *G08G 1/146* (2013.01)

(58) Field of Classification Search

CPC ..... G08G 1/143; G08G 1/0108; G08G 1/096855; G08G 1/146

See application file for complete search history.

(56) References Cited

U.S. PATENT DOCUMENTS

| | | | | |
|---|---|---|---|---|
| 5,940,481 | A * | 8/1999 | Zeitman | G06Q 20/127 340/932.2 |
| 6,927,700 | B1 | 8/2005 | Quinn | |
| 7,062,376 | B2 | 6/2006 | Oesterling | |
| 10,155,476 | B2 * | 12/2018 | Kim | B60R 1/00 |
| 10,510,251 | B2 * | 12/2019 | Rosen | G08G 1/148 |
| 2004/0254840 | A1 * | 12/2004 | Slemmer | G08G 1/146 705/22 |
| 2008/0033769 | A1 * | 2/2008 | Koorapati | G06Q 10/02 705/5 |
| 2010/0007525 | A1 * | 1/2010 | Shanbhag | G08G 1/14 340/932.2 |
| 2010/0280884 | A1 | 11/2010 | Levine | |

(Continued)

*Primary Examiner* — Emily C Terrell

(74) *Attorney, Agent, or Firm* — Sheppard, Mullin, Richter & Hampton LLP; Hector A. Agdeppa; Daniel N. Yannuzzi

(57) ABSTRACT

Systems and methods for collaborative parking assistance using a parking facilitation circuit are provided. A method may include: using information from a plurality of sensors to locate one or more available parking spaces in a determined area; characterize the located available parking spaces to generate parking space parameters for each of the available parking spaces; generating a parking space map comprising an indication of available parking spaces, locations of the available parking spaces and parking space parameters for the available parking spaces; filtering the parking space map to include as available parking spaces only those one or more available parking spaces that, based on the parking space parameters, are compatible with a vehicle intended to park in the determined area; and providing the filtered parking space map to a user interface of the vehicle.

37 Claims, 11 Drawing Sheets

(56) References Cited

U.S. PATENT DOCUMENTS

| | | | | |
|---|---|---|---|---|
| 2012/0092190 | A1* | 4/2012 | Stefik | G06Q 50/30 340/932.2 |
| 2012/0236149 | A1* | 9/2012 | Nagy | G08G 1/142 348/148 |
| 2013/0268187 | A1* | 10/2013 | Scofield | G01C 21/3685 701/400 |
| 2014/0176348 | A1* | 6/2014 | Acker, Jr. | G08G 1/144 340/932.2 |
| 2017/0200367 | A1* | 7/2017 | Mielenz | G05D 1/0246 |
| 2017/0208128 | A1 | 7/2017 | Stenneth | |
| 2017/0294121 | A1 | 10/2017 | Jain | |
| 2017/0357864 | A1 | 12/2017 | Welland | |
| 2018/0211539 | A1* | 7/2018 | Boss | G08G 1/168 |
| 2018/0218604 | A1* | 8/2018 | Astigarraga | H04L 67/12 |
| 2020/0079359 | A1* | 3/2020 | Tsujino | G05D 1/0088 |

* cited by examiner

PARKING FACILITATION SYSTEMS AND METHODS

TECHNICAL FIELD the present disclosure relates generally to the killer and infrastructure technology. More particularly, various embodiments relate to systems and methods for facilitating the location and access of parking spaces for passenger cars and other vehicles.

DESCRIPTION OF RELATED ART

Worldwide automobile sales have more than doubled in the past 2 decades, and global sales of passenger cars are projected to exceed 81 million units in 2018. The United States and China are typically among the largest automobile markets in the world wide, with US sales of passenger cars currently at around 7 million units per year. This combined with urban revival experienced by many major metropolitan areas has led to increased challenges for parking. The increasing cost of real estate exacerbates the problem by making it more difficult for developers to include sufficient room for adequate parking. A recent study reveals that US motorists spend an average of 17 hours per year searching for parking spaces on streets, in parking lots or in parking garages. This number is far greater in major metropolitan areas like New York, Los Angeles and San Francisco, where motorists may spend from 80 to over 100 hours per year looking for a parking spot.

A recent survey reports that 63% of 6000 US drivers surveyed have avoided driving to destinations because of parking challenges. This includes avoiding particular shopping destinations because of lack of parking and skipping leisure and sporting events. The same survey reports that 42% of the respondents experienced a missed appointment because of parking issues, and almost one-quarter responded that they experienced road rage out of their frustration due to the inability to find a parking space.

BRIEF SUMMARY OF THE DISCLOSURE

According to various embodiments of the disclosed technology a parking assistance system may include: a communication interface to receive sensor information from a plurality of sensors; an availability determination circuit to use the sensor information to determine one or available parking spaces from among the plurality of potential parking spaces; a parameter determination circuit to determine parking space parameters corresponding to the available parking spaces; a comparison circuit to compare vehicle profile information for a given vehicle to the parking space parameters to identify one or more available parking spaces compatible with the given vehicle; and a parking space mapping circuit to generate a parking space map of available identified compatible available parking spaces to the given vehicle that can be provided to the given vehicle.

The parking assistance system may include a parking facilitation circuit in a vehicle or in a cloud environment. The plurality of sensors may include at least one of sensors in an active vehicle, sensors in a passive vehicle and sensors of infrastructure elements. The sensors may include at least one of an image sensor and a proximity sensor.

The parking assistance system further may include a plurality of sensors in an active vehicle and a plurality of sensors and a plurality of sensors in passive vehicles, the sensors gathering information about potential parking spaces.

A method of collaborative parking assistance using a parking facilitation circuit, the method may include: using information from a plurality of sensors to locate one or more available parking spaces in a determined area; characterize the located available parking spaces to generate parking space parameters for each of the available parking spaces; generating a parking space map comprising an indication of available parking spaces, locations of the available parking spaces and parking space parameters for the available parking spaces; filtering the parking space map to include as available parking spaces only those one or more available parking spaces that, based on the parking space parameters, are compatible with a vehicle intended to park in the determined area; and providing the filtered parking space map to a user interface of the vehicle.

The filtering may include: obtaining a profile for each of one or more vehicles wherein each profile includes specification data for each vehicle; and comparing the profile for each of the one or more vehicles against the parking space parameters for available parking spaces to identify one or more compatible parking spaces for the vehicle. Filtering further may include obtaining a profile for a plurality of vehicles intended to be parked in the determined area, wherein each profile includes specification data for its corresponding vehicle; and comparing the profile for each of the plurality of vehicles against the parking space parameters for available parking spaces in the determined area to identify one or more parking spaces compatible with one or more of the plurality of vehicles intended to be parked in the determined area; and providing may further include transmitting the filtered parking space map to the plurality of vehicles.

The parking space map may be generated outside of the vehicle and transmitted to the vehicle by from an infrastructure element or from another vehicle. The user interface may display the parking space map to a user of the vehicle. The parking space availability may be determined using sensor information from a sensor of at least one of an active vehicle, a passive vehicle and an infrastructure element.

The user interface may accept a user input of a selected parking space and providing the selection to a navigation system of the vehicle so that the navigation system can generate instructions to navigate the vehicle to the selected parking space. The user interface may accept a user input of a selected parking space and providing the selection to the parking facilitation circuit to reserve the parking space for the user vehicle.

The plurality of sensors may include at least one of sensors in an active vehicle, sensors in a passive vehicle and sensors of infrastructure elements.

The parking facilitation circuit may update the parking space map reflecting unavailability of the reserved parking space. The parking space parameters may include at least one of length, width, and height of a parking space. The parking space parameters for a first parking space may be determined by taking measurements from proximity sensors of vehicles parked adjacent to the first parking space.

The determined area may be at least one of a geographic area, a geofenced area, a venue, a vicinity around a vehicle, a vicinity around a destination, and a parking facility.

Other features and aspects of the disclosed technology will become apparent from the following detailed description, taken in conjunction with the accompanying drawings, which illustrate, by way of example, the features in accordance with embodiments of the disclosed technology. The summary is not intended to limit the scope of any inventions described herein, which are defined solely by the claims attached hereto.

BRIEF DESCRIPTION OF THE DRAWINGS

The present disclosure, in accordance with one or more various embodiments, is described in detail with reference to the following figures. The figures are provided for purposes of illustration only and merely depict typical or example embodiments.

The figures are not exhaustive and do not limit the present disclosure to the precise form disclosed.

DETAILED DESCRIPTION

Embodiments of the systems and methods disclosed herein can be configured to facilitate identifying, locating and navigating to one or more suitable parking spaces for a vehicle. A parking facilitation system may be implemented to identify and locate available parking spaces, or parking spaces predicted to become available within a short period of time, and to share information about these parking spaces with the user community. The parking facilitation system may identify available parking spaces within a particular geographic area or geolocation. For example, the parking facilitation system can identify all parking spaces within a city, ZIP Code, region, geofence or other defined area.

The parking facilitation system can be a vehicle-based, server or cloud-based, or other computing or processing system that receives information from a plurality of sensors about potential parking spaces. The parking facilitation system evaluates this information and identifies possible parking spaces that may be available to users. Parking space parameters such as length, width, height, location, or other restrictions (e.g., handicapped, compact or other restrictions) can also be determined and associated with the corresponding parking spaces.

A parking space map may be generated showing available parking spaces and may also show relevant parking space parameters to the user. The system may be configured to allow the user or the vehicle to identify and select an available parking spot and to provide navigation information from a current location to the available parking spot. The system may be also configured to update and maintain real-time parking space maps.

Figure 1:
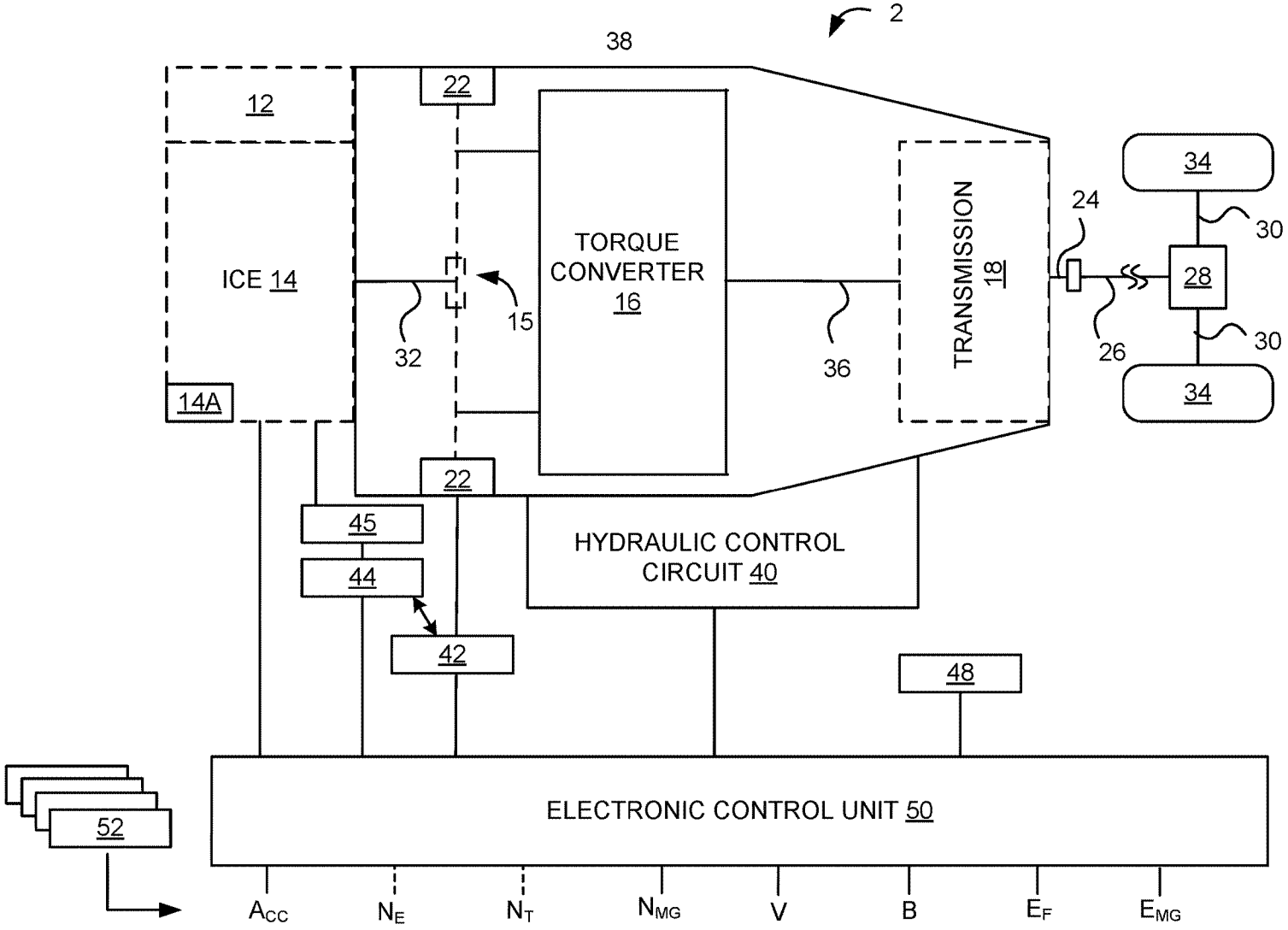
FIG. 1 is a schematic representation of an example vehicle with which embodiments of the systems and methods disclosed herein may be implemented.

The systems and methods disclosed herein may be implemented with any of a number of different vehicles and vehicle types. For example, the systems and methods disclosed herein may be used with automobiles, trucks, motorcycles, recreational vehicles and other like on-or off-road vehicles. In addition, the principals disclosed herein may also extend to other vehicle types as well. An example hybrid electric vehicle (HEV) in which embodiments of the disclosed technology may be implemented is illustrated in FIG. 1. Although the example described with reference to FIG. 1 is a hybrid type of vehicle, the systems and methods for facilitating parking can be implemented in other types of vehicle including gasoline- or diesel-powered vehicles, fuel-cell vehicles, electric vehicles, or other vehicles.

FIG. 1 illustrates a drive system of a vehicle that may include an internal combustion engine 14 and one or more electric motors 22 (which may also serve as generators) as sources of motive power. Driving force generated by the internal combustion engine 14 and motors 22 can be transmitted to one or more wheels 34 via a torque converter 16, a transmission 18, a differential gear device 28, and a pair of axles 30.

As an HEV, vehicle 2 may be driven/powered with either or both of engine 14 and the motor(s) 22 as the drive source for travel. For example, a first travel mode may be an engine-only travel mode that only uses internal combustion engine 14 as the source of motive power. A second travel mode may be an EV travel mode that only uses the motor(s) 22 as the source of motive power. A third travel mode may be an HEV travel mode that uses engine 14 and the motor(s) 22 as the sources of motive power. In the engine-only and HEV travel modes, vehicle 102 relies on the motive force generated at least by internal combustion engine 14, and a clutch 15 may be included to engage engine 14. In the EV travel mode, vehicle 2 is powered by the motive force generated by motor 22 while engine 14 may be stopped and clutch 15 disengaged.

Engine 14 can be an internal combustion engine such as a gasoline, diesel or similarly powered engine in which fuel is injected into and combusted in a combustion chamber. A cooling system 12 can be provided to cool the engine 14 such as, for example, by removing excess heat from engine 14. For example, cooling system 12 can be implemented to include a radiator, a water pump and a series of cooling channels. In operation, the water pump circulates coolant through the engine 14 to absorb excess heat from the engine. The heated coolant is circulated through the radiator to remove heat from the coolant, and the cold coolant can then be recirculated through the engine. A fan may also be included to increase the cooling capacity of the radiator. The water pump, and in some instances the fan, may operate via a direct or indirect coupling to the driveshaft of engine 14. In other applications, either or both the water pump and the fan may be operated by electric current such as from battery 44.

An output control circuit 14A may be provided to control drive (output torque) of engine 14. Output control circuit 14A may include a throttle actuator to control an electronic throttle valve that controls fuel injection, an ignition device that controls ignition timing, and the like. Output control circuit 14A may execute output control of engine 14 according to a command control signal(s) supplied from an electronic control unit 50, described below. Such output control can include, for example, throttle control, fuel injection control, and ignition timing control.

Motor 22 can also be used to provide motive power in vehicle 2 and is powered electrically via a battery 44. Battery 44 may be implemented as one or more batteries or other power storage devices including, for example, lead-acid batteries, lithium ion batteries, capacitive storage devices, and so on. Battery 44 may be charged by a battery charger 45 that receives energy from internal combustion engine 14. For example, an alternator or generator may be coupled directly or indirectly to a drive shaft of internal combustion engine 14 to generate an electrical current as a result of the operation of internal combustion engine 14. A clutch can be included to engage/disengage the battery charger 45. Battery 44 may also be charged by motor 22 such as, for example, by regenerative braking or by coasting during which time motor 22 operate as generator.

Motor 22 can be powered by battery 44 to generate a motive force to move the vehicle and adjust vehicle speed. Motor 22 can also function as a generator to generate electrical power such as, for example, when coasting or braking. Battery 44 may also be used to power other electrical or electronic systems in the vehicle. Motor 22 may be connected to battery 44 via an inverter 42. Battery 44 can include, for example, one or more batteries, capacitive storage units, or other storage reservoirs suitable for storing electrical energy that can be used to power motor 22. When battery 44 is implemented using one or more batteries, the batteries can include, for example, nickel metal hydride batteries, lithium ion batteries, lead acid batteries, nickel cadmium batteries, lithium ion polymer batteries, and other types of batteries.

An electronic control unit 50 (described below) may be included and may control the electric drive components of the vehicle as well as other vehicle components. For example, electronic control unit 50 may control inverter 42, adjust driving current supplied to motor 22, and adjust the current received from motor 22 during regenerative coasting and breaking. As a more particular example, output torque of the motor 22 can be increased or decreased by electronic control unit 50 through the inverter 42.

A torque converter 16 can be included to control the application of power from engine 14 and motor 22 to transmission 18. Torque converter 16 can include a viscous fluid coupling that transfers rotational power from the motive power source to the driveshaft via the transmission. Torque converter 16 can include a conventional torque converter or a lockup torque converter. In other embodiments, a mechanical clutch can be used in place of torque converter 16.

Clutch 15 can be included to engage and disengage engine 14 from the drivetrain of the vehicle. In the illustrated example, a crankshaft 32, which is an output member of engine 14, may be selectively coupled to the motor 22 and torque converter 16 via clutch 15. Clutch 15 can be implemented as, for example, a multiple disc type hydraulic frictional engagement device whose engagement is controlled by an actuator such as a hydraulic actuator. Clutch 15 may be controlled such that its engagement state is complete engagement, slip engagement, and complete disengagement complete disengagement, depending on the pressure applied to the clutch. For example, a torque capacity of clutch 15 may be controlled according to the hydraulic pressure supplied from a hydraulic control circuit (not illustrated). When clutch 15 is engaged, power transmission is provided in the power transmission path between the crankshaft 32 and torque converter 16. On the other hand, when clutch 15 is disengaged, motive power from engine 14 is not delivered to the torque converter 16. In a slip engagement state, clutch 15 is engaged, and motive power is provided to torque converter 16 according to a torque capacity (transmission torque) of the clutch 15.

As alluded to above, vehicle 102 may include an electronic control unit 50. Electronic control unit 50 may include circuitry to control various aspects of the vehicle operation. Electronic control unit 50 may include, for example, a microcomputer that includes a one or more processing units (e.g., microprocessors), memory storage (e.g., RAM, ROM, etc.), and I/O devices. The processing units of electronic control unit 50, execute instructions stored in memory to control one or more electrical systems or subsystems in the vehicle. Electronic control unit 50 can include a plurality of electronic control units such as, for example, an electronic engine control module, a powertrain control module, a transmission control module, a suspension control module, a body control module, and so on. As a further example, electronic control units can be included to control systems and functions such as doors and door locking, lighting, human-machine interfaces, cruise control, telematics, braking systems (e.g., ABS or ESC), battery management systems, and so on. These various control units can be implemented using two or more separate electronic control units, or using a single electronic control unit.

In the example illustrated in FIG. 1, electronic control unit 50 receives information from a plurality of sensors included in vehicle 102. For example, electronic control unit 50 may receive signals that indicate vehicle operating conditions or characteristics, or signals that can be used to derive vehicle operating conditions or characteristics. These may include, but are not limited to accelerator operation amount, $A_{CC}$, a revolution speed, $N_E$, of internal combustion engine 14 (engine RPM), a rotational speed, $N_{MG}$, of the motor 22 (motor rotational speed), and vehicle speed, $N_V$. These may also include torque converter 16 output, $N_T$ (e.g., output amps indicative of motor output), brake operation amount/pressure, B, battery SOC (i.e., the charged amount for battery 44 detected by an SOC sensor).

Accordingly, vehicle 102 can include a plurality of sensors 52 that can be used to detect various conditions internal or external to the vehicle and provide sensed conditions to engine control unit 50 (which, again, may be implemented as one or a plurality of individual control circuits). In one embodiment, sensors 52 may be included to detect one or more conditions directly or indirectly such as, for example, fuel efficiency, $E_F$, motor efficiency, $E_{MG}$, hybrid (internal combustion engine 14+MG 12) efficiency, acceleration, $A_{CC}$, and so on.

In some embodiments, one or more of the sensors 52 may include their own processing capability to compute the results for additional information that can be provided to electronic control unit 50. In other embodiments, one or more sensors may be data-gathering-only sensors that provide only raw data to electronic control unit 50. In further embodiments, hybrid sensors may be included that provide a combination of raw data and processed data to electronic control unit 50. Sensors 52 may provide an analog output or a digital output.

Sensors 52 may be included to detect not only vehicle conditions but also to detect external conditions as well. Sensors that might be used to detect external conditions can include, for example, sonar, radar, lidar or other vehicle proximity sensors, and cameras or other image sensors. Image sensors can be used to detect, for example, traffic signs indicating a current speed limit, road curvature, other vehicles, parking spaces, obstacles, and so on. Still other sensors may include those that can detect road grade. While some sensors can be used to actively detect passive environmental objects, other sensors can be included and used to detect active objects such as those objects used to implement smart roadways that may actively transmit and/or receive data or other information.

The examples of FIG. 1 is provided for illustration purposes only as an example of a vehicle with which embodiments of the disclosed technology may be implemented. One of ordinary skill in the art reading this description will understand how the disclosed embodiments can be implemented with other vehicle platforms.

Figure 2:
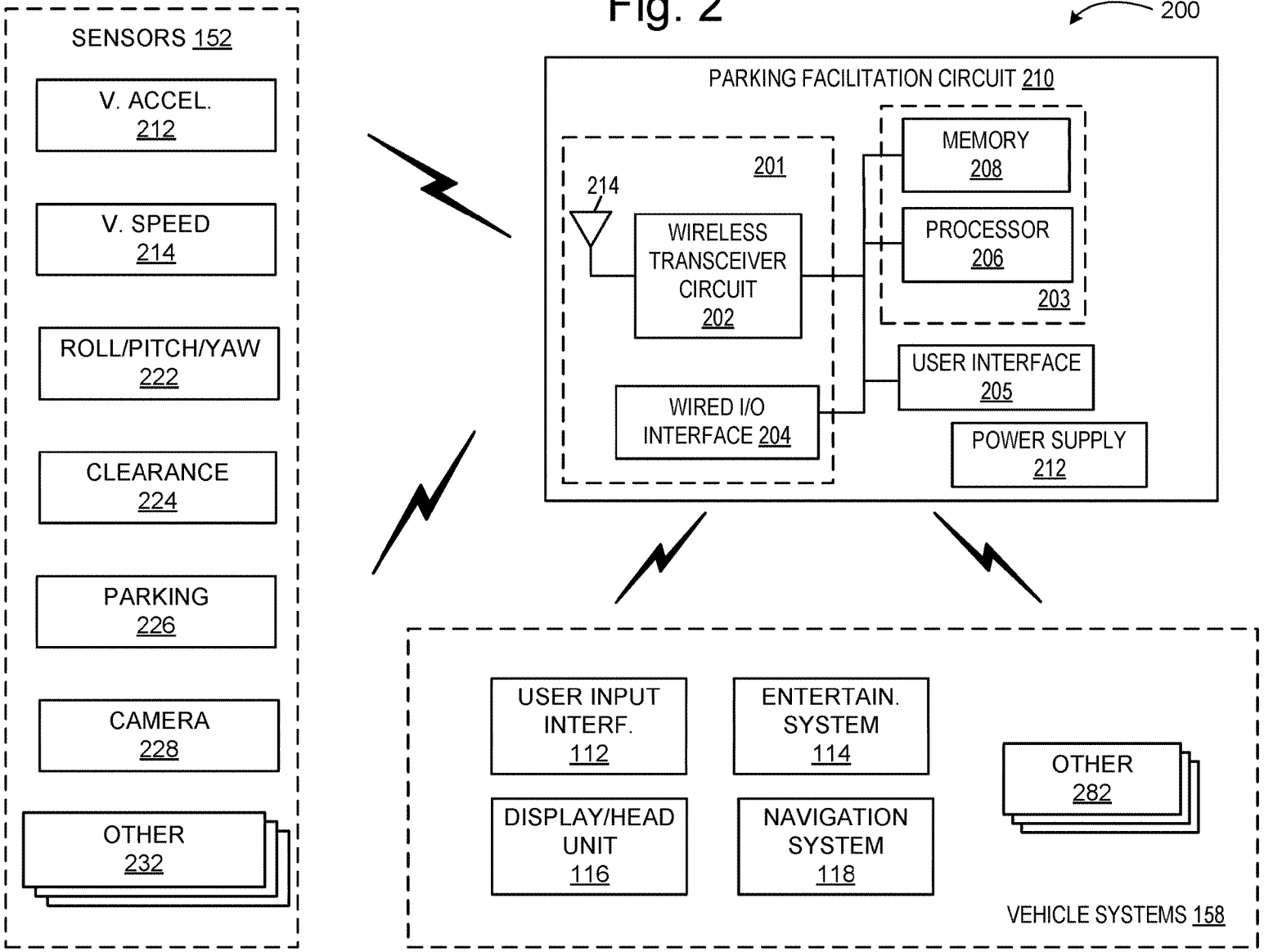
FIG. 2 illustrates an example architecture for an in-vehicle parking facilitation system in accordance with one embodiment of the systems and methods described herein.

FIG. 2 illustrates an example architecture for parking assist system in accordance with one embodiment of the systems and methods described herein. Referring now to FIG. 2, in this example, parking assist system 200 includes a parking facilitation circuit 210, a plurality of sensors 152, and a plurality of vehicle systems 158. Sensors 152 and vehicle systems 158 can communicate with parking facilitation circuit 210 via a wired or wireless communication interface. Although sensors 152 and vehicle systems 158 are depicted as communicating with parking facilitation circuit 210, they can also communicate with each other as well as with other vehicle systems. In some embodiments, parking facilitation circuit 210 can be implemented as an ECU or as part of an ECU such as, for example electronic control unit 50. In other embodiments, parking facilitation circuit 210 can be implemented independently of the ECU.

Parking facilitation circuit 210 in this example includes a communication circuit 201, a decision circuit 203 (including a processor 206 and memory 208 in this example) and a power supply 212. Components of parking facilitation circuit 210 are illustrated as communicating with each other via a data bus, although other communication in interfaces can be included. Parking facilitation circuit 210 in this example also includes a user interface 205 that can be accessed by the user to operate parking facilitation circuit 210. User interface may also or alternatively be accomplished via other input and display mechanism such as, for example, the vehicle's navigation system, entertainment system, head unit, or otherwise.

Processor 206 can include a GPU, CPU, microprocessor, or any other suitable processing system. The memory 208 may include one or more various forms of memory or data storage (e.g., flash, RAM, etc.) that may be used to store the calibration parameters, images (analysis or historic), point parameters, instructions and variables for processor 206 as well as any other suitable information. Memory 208, can be made up of one or more modules of one or more different types of memory, and may be configured to store data and other information as well as operational instructions that may be used by the processor 206 to parking facilitation circuit 210.

Although the example of FIG. 2 is illustrated using processor and memory circuitry, as described below with reference to circuits disclosed herein, decision circuit 203 can be implemented utilizing any form of circuitry including, for example, hardware, software, or a combination thereof. By way of further example, one or more processors, controllers, ASICs, PLAs, PALs, CPLDs, FPGAs, logical components, software routines or other mechanisms might be implemented to make up a parking facilitation circuit 210.

Communication circuit 201 includes either or both a wireless transceiver circuit 202 with an associated antenna 214 and a wired I/O interface 204 with an associated hardwired data port (not illustrated). As this example illustrates, communications with parking facilitation circuit 210 can include either or both wired and wireless communications circuits 201. Wireless transceiver circuit 202 can include a transmitter and a receiver (not shown) to allow wireless communications via any of a number of communication protocols such as, for example, WiFi, Bluetooth, near field communications (NFC), Zigbee, and any of a number of other wireless communication protocols whether standardized, proprietary, open, point-to-point, networked or otherwise. Antenna 214 is coupled to wireless transceiver circuit 202 and is used by wireless transceiver circuit 202 to transmit radio signals wirelessly to wireless equipment with which it is connected and to receive radio signals as well. These RF signals can include information of almost any sort that is sent or received by parking facilitation circuit 210 to/from other entities such as sensors 152 and vehicle systems 158.

Wired I/O interface 204 can include a transmitter and a receiver (not shown) for hardwired communications with other devices. For example, wired I/O interface 204 can provide a hardwired interface to other components, including sensors 152 and vehicle systems 158. Wired I/O interface 204 can communicate with other devices using Ethernet or any of a number of other wired communication protocols whether standardized, proprietary, open, point-to-point, networked or otherwise.

Power supply 210 can include one or more of a battery or batteries (such as, e.g., Li-ion, Li-Polymer, NiMH, NiCd, NiZn, and $NiH_2$, to name a few, whether rechargeable or primary batteries), a power connector (e.g., to connect to vehicle supplied power, etc.), an energy harvester (e.g., solar cells, piezoelectric system, etc.), or it can include any other suitable power supply.

Sensors 152 can include, for example, sensors 52 such as those described above with reference to the example of FIG. 1. Sensors 152 can include additional sensors that may or not otherwise be included on a standard vehicle 10 with which the turn assist-mode system 200 is implemented. In the illustrated example, sensors 152 include vehicle acceleration sensors 212, vehicle speed sensors 214, accelerometers such as a 3-axis accelerometer 222 to detect roll, pitch and yaw of the vehicle, vehicle clearance sensors 224, parking sensors 226, and camera 228 (e.g., to detect open parking spaces and provide imagery of possible parking spaces). Additional sensors 232 can also be included as may be appropriate for a given implementation of parking facilitation system 200. Parking sensors 226 can include, for example, infrared, radar, lidar, sonar or other like distance measurement or object detection sensors.

Vehicle systems 158 can include any of a number of different vehicle components or subsystems used to control or monitor various aspects of the vehicle and its performance. In this example, the vehicle systems 158 include a GPS, smartphone (e.g., directly or via a head-unit interface such as Android Auto) or other vehicle positioning system 118; entertainment system 114; head unit 116; and other user interfaces or input/output devices 112. In some embodiments, some or all of these may be integrated into a single system such as, for example, a head unit that includes one or more of navigation, entertainment, telephone, vehicle setting, and other functions.

During operation, parking facilitation circuit 210 can receive information from various vehicle sensors to determine whether the assist mode should be activated. Communication circuit 201 can be used to transmit and receive information between parking facilitation circuit 210 and sensors 152, and parking facilitation circuit 210 and vehicle systems 158. Also, sensors 152 may communicate with vehicle systems 158 directly or indirectly (e.g., via communication circuit 201 or otherwise).

In various embodiments, communication circuit 201 can be configured to receive data and other information from sensors 152 that is used in determining whether to activate the parking facilitation mode. Additionally, communication circuit 201 can be used to send an activation signal or other activation information to various vehicle systems 158 as part of entering the parking facilitation mode.

Figure 3:
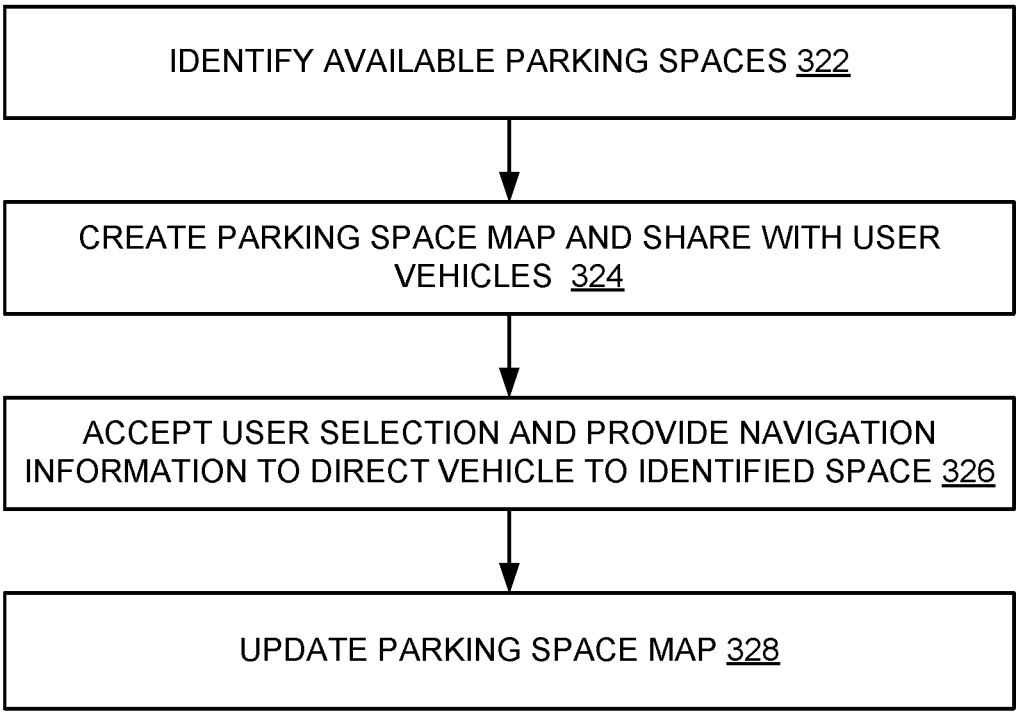
FIG. 3 illustrates an example high-level operation of a parking facilitation system in accordance with one embodiment.

FIG. 3 illustrates an example high-level operation of a parking facilitation system in accordance with one embodiment. In various embodiments, a parking facilitation system can be used to identify and locate available parking spaces, or parking spaces predicted to become available within a short period of time, and to share information about these parking spaces with the user community. For example, a parking facilitation system can be a vehicle-based, server or cloud-based, or other computing or processing system that receives information from a plurality of sensors about potential parking spaces. The parking facilitation system evaluates this information and identifies possible parking spaces that may be available to users. Parking space parameters such as length, with, height, location, restrictions (e.g., handicapped, compact or other restrictions) can also be determined and associated with the corresponding parking spaces.

With reference now to FIG. 3, at operation 322 the parking facilitation system identifies available parking spaces within a particular geographic area or geolocation. For example, the parking facilitation system can identify all parking spaces within a city, ZIP Code, region, geofence or other defined area. In some applications, the parking facilitation system can identify available parking spaces within a given range (e.g., radius) of a particular vehicle, within range of a venue or destination, had a particular parking lot or within a particular parking garage, within a section of a parking lot or parking garage, and so on. This information can be gathered based on, for example, sensor information collected from sensors at locations such as active or moving vehicles, passive or parked vehicles, infrastructure elements, and so on.

At operation 324, the parking facilitation system creates a parking space map of available parking spaces and shares this map with user vehicles. For example, a user traveling to a particular destination may request a parking space map available parking spaces at or near that destination. In some embodiments, this might be a feature that can be enabled/disabled by a user through the vehicle navigation system. For example, the request/retrieval of a parking space map can a mode selected in a settings menu in the vehicle navigation system to automatically occur upon entry of a destination. As another example, a user may request a parking space map showing available spaces within a given radius of the user's current location, which may be updated as the user's location changes. The parking facilitation system can be set to automatically update the map as availability changes.

In some embodiments, the generation of the parking space map may occur at the vehicle such as by a parking facilitation circuit 210, receiving input from a plurality of sensors. In other embodiments, the parking space map may be generated by another vehicle and shared with the user's vehicle, or it may be generated in the cloud or another location remote from the user's vehicle.

Upon receiving the parking space map, the user may view the map and select a parking space. At operation 326, the parking facilitation system accepts user selection of a parking space and provides navigation information to direct the user to the identified space. In some embodiments, selection can be done via the vehicle head unit, navigation system or other vehicle system (e.g., display/head unit 116, navigation system 118, entertainment system 114 for user interface 112) and provided to the parking facilitation system. Directions return-by-turn instructions can be provided to the user such as, for example, by a vehicle navigation system (e.g., navigation system 118) or another communications interface such as, for example, the Toyota Safety Connect® system or other like system. In some embodiments, the parking facilitation system may reserve a spot for the user upon user selection. Additionally, payment for the spot can be collected (e.g., through a user account) upon reservation. The payment amount can be trued up or down when the vehicle vacates parking spot.

At operation 328, the parking facilitation system updates parking space map at the time of reservation or at the time the vehicle enters the parking spot. In various embodiments, the parking space map can be updated on a real-time basis has parking spaces become available, are taken, or the parking landscape otherwise changes.

Figure 4:
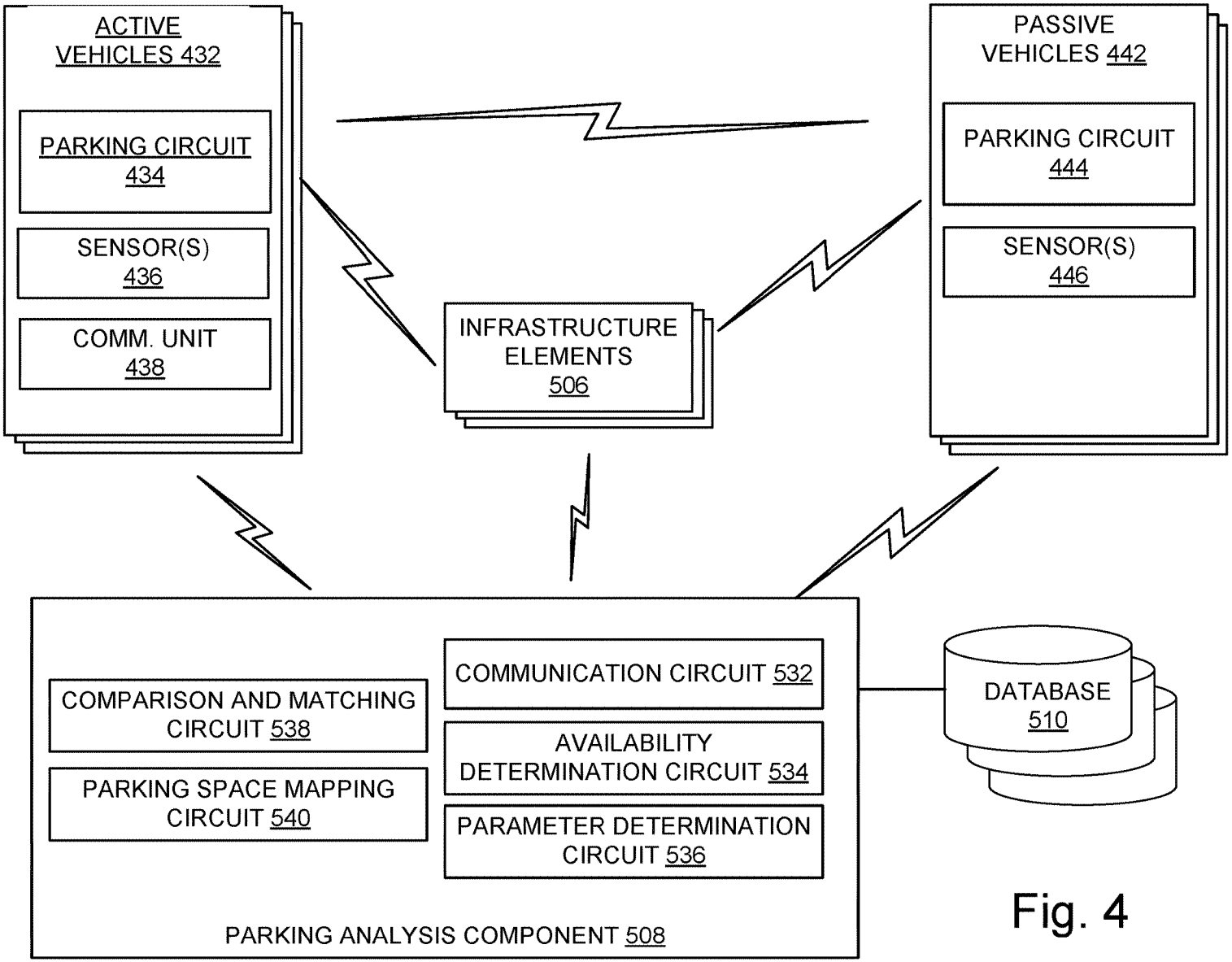
FIG. 4 illustrates an example of a parking facilitation system in accordance with various embodiments.

Having provided a high-level overview of various embodiments of parking facilitation systems and methods, an example parking facilitation system is described. FIG. 4 illustrates an example of a parking facilitation system in accordance with various embodiments. With reference now to FIG. 4, this example illustrates components of the parking facilitation system as including active vehicles 432, passive vehicles 442, infrastructure elements 506, parking analysis component 508, and one or more databases 510. Active vehicles 432 can include, for example, one or more passenger vehicles, commercial vehicles, utility vehicles, or other vehicles that include one or more appropriate sensors 436 (e.g., one or more of sensors 158) to provide information relevant to parking space determination and a communications unit 438 to communicate with one or more of the other system elements such as, for example, other vehicles 432, 442, infrastructure elements 506 and parking analysis component 508. Active vehicles 432 may include, for example, vehicles traveling along the roadway or within parking lots or garages with sensors equipped to measure or gather information about the area surrounding the vehicle.

Passive vehicles 442 can include, for example, one or more passenger vehicles, commercial vehicles, utility vehicles, or other vehicles that include one or more appropriate sensors 446 (e.g., one or more of sensors 158) to provide information relevant to parking space determination and a communications unit 448 to communicate with one or more of the other system elements such as, for example, other vehicles 432, 442, infrastructure elements 506 and parking analysis component 508. Passive vehicles 442 may include, for example, vehicles parked and parking spaces with sensors equipped to measure or gather information about the area surrounding vehicle.

Infrastructure elements 506 may include one or more sensors or other elements that can detect information about the parking landscape. For example, infrared or other like sensors mounted above parking spaces can be used to detect the presence or absence of vehicles in their corresponding parking spaces. Similarly, loops, scales or other sensors can be embedded on the surface of or below parking spaces to detect the presence or absence of vehicles and their corresponding parking spaces. As further examples, parking meters, streetlamps, road signs, and other elements generally provided to perform other functions or services, can be augmented to include proximity sensors, image sensors, or other sensors that may be useful to detect the absence or presence of vehicles and parking spaces. Infrastructure elements 506 may include communications capability to communicate sensor information to the other elements of the parking facilitation system such as, for example, vehicles 432, 442, other infrastructure elements 506 and parking analysis component 508. In some embodiments, this communication capability may be part of a backend system or larger infrastructure to which the infrastructure element sensor are connected.

Parking analysis component 508 receives sensor information from the various system components such as from one or more of active vehicles 432, passive vehicles 442 and infrastructure elements 506. The sensor information may be raw data or may include partially or fully processed data such as, for example, data that may be processed by a parking circuit 434, 444 (e.g., parking facilitation circuit 210), or by similar circuits in the infrastructure. The sensor information and other information may be received by communication circuit 532. Communication circuit 532 may also communicate information from parking analysis component 508 to other system elements.

Parking space mapping circuit 540 can accept the raw or processed data and perform the processing necessary to generate a parking space map. For example, availability determination circuit 534 can use the sensor information to determine one or more available parking spaces from among a plurality of potential parking spaces within a determined area. As alluded to above, sensor information can be used to not only detect the absence or presence of a vehicle in a parking space, but to also detect parking space parameters for parking spaces. This may include, for example, the length, with and height of available parking spaces; the absence or presence of restrictions on available parking spaces (e.g. handicapped only, loading/unloading only, taxi only, hours restrictions, permit restrictions and so on); and other parameters that may be relevant to the suitability of a corresponding parking space to user vehicles. Accordingly, parameter determination circuit 536 can be implemented to use the sensor data to determine the various parameters that may be relevant.

Parking analysis component 508 can share the generated parking space map with one or more active vehicles and passive vehicles 432, 444, and can also store generated parking space maps in database 510. This information can be shared, for example, using communication circuit 532. Parking analysis component 508 can also store additional information in database 510 such as, for example, parking space parameters and so on. In some instances, parking space parameters may frequently change and thus might only be stored in conjunction with one or more corresponding parking space maps.

This might include, for example, parking space dimensions which may change as vehicles come and go from surrounding parking spaces. In other instances, parking space parameters may be longer-term parameters that can be stored a long-term basis. Items that might be stored on a longer-term basis might include, for example, handicap restrictions, permit restrictions, parking hours restrictions, vehicle type restrictions, area crime rates, availability of electric charging and so on. Storing these parameters on a long-term or permanent basis can allow the system to retrieve these parameters and associate them with corresponding parking spaces on a parking space map when a real-time parking space map is generated.

Comparison and matching circuit 538 can be used to compare parameters of available parking spaces with profile information characterizing vehicles that are intending to park in a given area to locate spaces that are compatible with vehicles. This information can be used to filter from the parking space map those otherwise available spaces that are not compatible with a vehicle based on vehicle characteristics. For example, a vehicle may be too large for a given space or the space may have other restrictions such as handicap, permit, or special vehicle restrictions. Using comparison and matching circuit 534 to identify compatible spaces and filter out incompatible spaces can avoid sending the necessary information to vehicles intending to park.

Parking space analysis component 508 can be a cloud-based or other remote processing system to process information received from the parking facilitation system elements, generate the parking space maps and otherwise perform the functions described herein. In other embodiments, parking space analysis component 508 can be local to one or more active vehicles 432 are passive vehicles 442, such that these vehicles in individual, or shared, capacity can perform the parking analysis component functions. As yet another example, parking analysis component 508 can be part of the infrastructure that supports its infrastructure elements 506. For example, a parking analysis component 508 can be part of a parking garage, parking lot, or other like facility, or it can be part of a city, town or other region, to perform the parking analysis component functions. As yet a further example, the functions of parking analysis component 508 can be shared among any or all of the foregoing constituent components.

Figure 5:
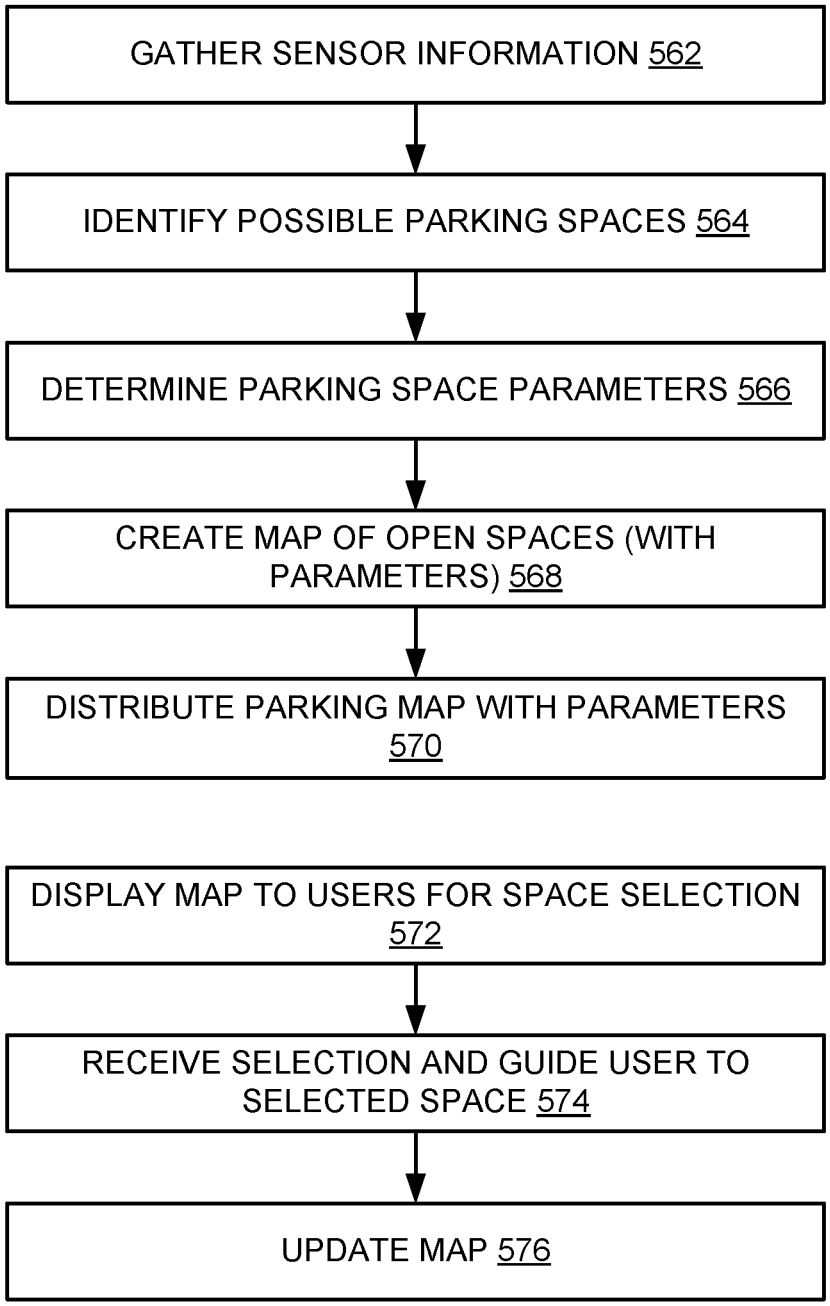
FIG. 5 illustrates an example process for parking facilitation in accordance with one embodiment.

FIG. 5 illustrates an example process for parking facilitation in accordance with one embodiment. With reference now to FIG. 5, in this example sensor information is gathered from various elements of the parking facilitation system. For example, sensor information can be gathered from one or more of active vehicles 432, passive vehicles 442, and infrastructure elements 506. As noted above, the sensor information can be raw sensor data gathered by sensors and transmitted to the parking facilitation system, or the center information can be processed locally by the sensors or by a parking facilitation circuit at the vehicles or infrastructure elements at which the information is gathered.

At operation 564, possible parking spaces are identified based on the sensor information. Proximity sensors, image sensors, current loops, or other sensors can be used to identify open parking spaces within a parking garage or parking lot, or open spaces alone a street or thoroughfare for on-street parking. As one example, parked vehicles (e.g., passive vehicles 442) may include proximity sensors such that vehicles may measure distances between themselves and nearby objects. For example, a vehicle can measure the amount of space in front of or behind the vehicle to identify opportunities for parallel parking along the street. As another example, side sensors can measure the distances to adjacent vehicles on either side of a parked vehicle such that parked vehicles can share information relevant to the width of adjacent parking spaces. They may also include image sensors to gather image information about the space surrounding the vehicles, which can also be used to detect and evaluate available parking spaces. As yet another example, traveling vehicles (e.g., active vehicles 432) may also include proximity sensors and image sensors to evaluate the environment about the vehicle as it travels along a road or through a parking area. Proximity sensors and cameras may detect open spaces and measure the parameters of those open spaces.

In each example, cameras may be used to capture imagery of available parking spaces that can be shared with system users who can view the parking spaces (e.g., on their head unit or navigation system) before selecting a parking space or navigating to a chosen parking space. Cameras may be also used to capture signage or other visual information that may be relevant to parking space parameters such as, for example, handicap restrictions, parking hours restrictions, permit restrictions and so on. As noted above with reference to operation 562, the sensor information can be raw data or processed information.

At operation 566, the parking facilitation system determines parking space parameters. In some embodiments, this determination is only done for available parking spaces. In other embodiments, this determination can be made for all parking spaces. As noted above, in some instances parking space parameters can be stored in a long-term basis and linked to corresponding parking spaces. Sensor data from elements such as active vehicles, passive vehicles and infrastructure elements can be used to determine parking space parameters. For example, the same or similar sensors as those sensors described above with reference to operation 564. Data from proximity sensors, image sensors and other sensors included at active vehicles, passive vehicles and infrastructure elements, can also be used to determine parking space parameters. Determined parking space parameters can be stored and linked to their corresponding parking spaces.

At operation 568, the parking facilitation system creates a parking space map that can be used by users of the parking facilitation system (e.g., vehicle operators, passengers or dispatchers). The parking space map can be a list of available spaces that can be provided to one or more users of the system. For example, in some embodiments, the parking space map can show a listing of available spaces that can be sorted by a number of parameters. For example, the sort parameters can include sorting by street, sorting by location, sorting by cost, alphabetizing, and so on. In other embodiments, the parking space map can include a visual map of the street or parking grid that shows the parking landscape of a given area with representations of vehicles in spaces that are taken, and no vehicle representations in spaces that are open.

The parking space map can include parking space parameters such as parking restrictions, cost for parking, and so on. Where the parking space map comprises a list, the list can include this information and it can be color-coded, bolded, or otherwise accentuated to delineate the various parameters. For the parking space map comprises a visual map, open spots can be highlighted and textual or graphic legends can be included to show, parking space parameters. For example, a handicap icon can be overlaid on handicap spaces, or handicap spaces can be highlighted in blue. As another example, cost information can be superimposed over open spaces. As yet another example, area crime statistics or ratings, availability of electric charging facilities, on-site washing were detailing, or other information can be included in the map and can be superimposed over a visual representation of the parking space map. As these examples illustrate, any of a number of highlighting, colorization and legend ink techniques can be used to provide additional information to the user about the parking area and the available parking spaces.

At operation 570, the parking facilitation system distributes the parking space map. Where the parking space map includes parking space parameters, those parameters can be distributed with the parking space map. In some embodiments, a parking space map can be generated as a custom map for one or more users based on user defined parameters. For example, a user may request a parking space map for a particular venue or destination, and the user may request certain characteristics. Further to this example, the user might request a parking space map for a local theater and may request parking for a large vehicle such as a large SUV or pickup truck. Alternatively, the user might request all spots in an area that except a particular type of parking permit. As yet another alternative, the user might request all spots within a certain price range, or that allow parking for a certain minimum number of hours. In another embodiment, parking space map can be generated and distributed for a plurality of users within a given location, area or geofence.

As these examples illustrate, user requests may include one or more parking space parameters and the provided parking space map can be filtered accordingly. In some applications, user-specific parameters can be stored with the user's vehicle such that parameters that the user always wishes to specify can be uploaded with the map request. For example, these parameters can be stored with vehicle systems 158 or in memory 208 of parking facilitation system 210. For vehicles that include unique driver identification capabilities, multiple sets of parameters can be stored to accommodate multiple drivers of the same vehicle. Where rental or car-share vehicles are involved, parameters might be stored in the cloud so that they can be retrieved for a given driver regardless of which vehicle he or she enters, although cloud storage is not limited to this particular application.

At operation 572, the parking map is distributed with the requested parameters. As noted above, the parking space map might be displayed as a map or a textual listing on a graphical user interface such as a navigation system, center console display, binnacle display. In other embodiments, the parking space map might be provided to the user audibly such as, for example, via the vehicle head unit, navigation system or audio system. In yet further embodiments, the parking space map might be provided to user audibly through remote communication system such as, for example, the Toyota Safety Connect system. The parking space map can be filtered to display only those spots meeting the user's (or the user vehicle's) acceptable parking space parameters. As noted above, in some embodiments the filtering can be performed upon creation of map by the parking facilitation system such that filtered maps can be provided to the user. In other embodiments, an unfiltered map might be sent to the user vehicle and processing capabilities within the user vehicle (e.g. parking facilitation system 210) be used to filter or other appropriately and modify and received parking space map. As also noted above, the map can be highlighted, color-coded, legended, or otherwise annotated to display parking space parameters.

Upon receipt of the parking space map, the user can choose a spot and drive his or her vehicle to that spot. Alternatively, the system can be configured to choose a spot for the user based on user preferences or other parameters. At operation 574, the parking facilitation system receives the user selection and guides the user to the selected space.

For example, the system can automatically download the destination or navigation instructions to a navigation system of the vehicle (e.g. navigation system 118). As another example, the parking facilitation system can provide turn by turn instructions to the chosen parking space. In various applications, the parking facilitation system may also allow the user to reserve a parking spot, as described in more detail below.

In some autonomous vehicle applications, the vehicle itself may choose the spot based on a predetermined ranking of user preferences (which may be based on parking space parameters) and, through one or more levels of autonomous operation, proceed to the chosen spot. In other autonomous vehicle operations, the vehicle may allow the user to choose his or her preferred spot manually.

At operation 576, the parking facilitation system updates the parking space map to note that the chosen space is occupied. This can be done upon the receipt of a reservation by the user or can be done when the user actually arrives at and parks in the parking spot. The parking facilitation system may continuously update parking space maps for various venues, destinations, areas, locations, geofence regions etc., and provide updated maps in real-time to users either continuously, or upon request. Again, the provided maps can be filtered based on user-specified parking space parameter requirements.

Figure 6:
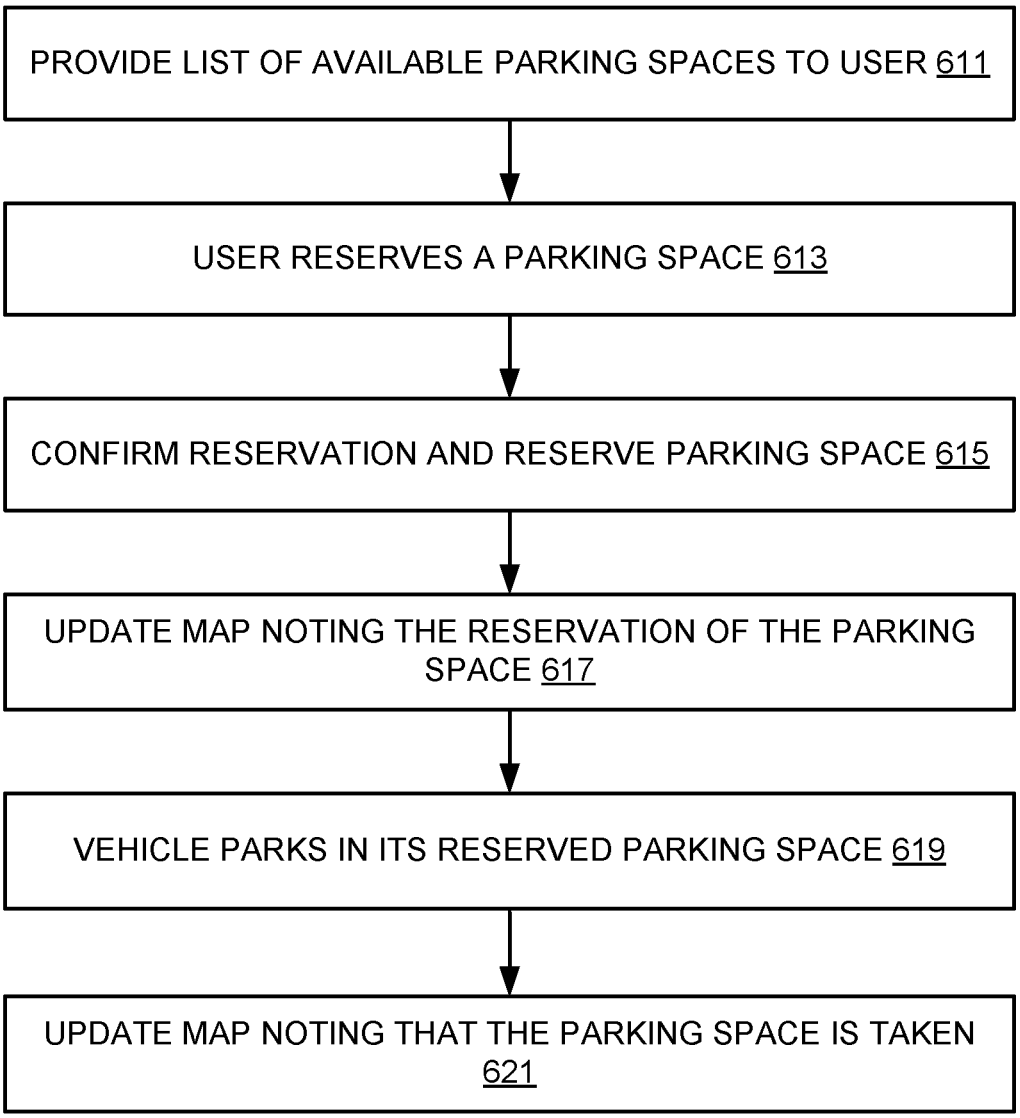
FIG. 6 illustrates another example of a process for facilitating parking in accordance with one embodiment.

FIG. 6 illustrates another example of a process for facilitating parking in accordance with one embodiment. In this example, the user is given the opportunity to reserve a parking space in advance of his or her arrival at that parking space. With reference now to FIG. 6, at operation 611 a parking space map, which may be a list of available parking spaces, is provided to the user.

At operation 613 the user selects a space from the parking space map and reserves the parking space. In some instances, reservations may only be taken for available parking spaces. In other instances, reservations may be made in advance for a particular parking space even if the parking spaces currently occupied at the time of reservation. In such implementations, the system may determine the amount of time various parked vehicles will remain in their parking spaces and map of upcoming vacancies and times of vacancies may be provided.

At operation 615 the reservation is confirmed in the parking spaces reserved. The user is sent a reminder or verification of the reservation. In some embodiments, payment may be collected at time of reservation through an automated process. For example, the user may set up an account or otherwise provide payment information for the reservation.

At operation 617, the parking facilitation system updates its data noting the reservation of the reserved parking space. This information can be included in generated parking space maps to reflect the nonavailability of the parking space. Where parking spaces reserved for a period of time, the nonavailability can show for those times at which the spaces reserved, and the space can be shown as available otherwise.

At operation 619, the vehicle parks in its reserved parking space. Vehicle identifiers can be used to confirm that the vehicle is permitted to park in its designated reserved space. This can include, optical (e.g., barcode, QR code, license plate recognition, etc.), RF (e.g., NFC, Bluetooth, Wi-Fi, cellular, etc.), or other wireless communication techniques to allow the vehicle to communicate with the parking lot infrastructure for the permitted parking. For controlled access parking facilities, these communication capabilities may also be used to allow access to the facility. For example, the vehicle or user ID can be provided to the parking facility access systems (e.g., gates, etc.) so that the vehicle with the proper reservation is allowed access into the parking facility. Where reservations are paid for through the parking facilitation system, this information can also be used to allow the vehicle to exit the controlled-access facility without further payment.

Electronic signs or other indicators can also be included at the parking spaces to indicate the state of reservation of parking spaces. For example, a sign displaying AVAILABLE or RESERVED, can be included at each parking space and updated based on reservation status. As a further example, user or vehicle identification information can be included on the display to help the user identify the proper spot when he or she arrives at his or her destination. Because vehicle communication (e.g., V2I) can be used to communicate with the parking facility, the indicator can be configured to flash or otherwise alert the driver that he or she has arrived at the correct parking.

At operation 621, the map can be updated to note that the parking space is actually occupied by the user. Where the user does not arrive at his or her designated time, the system can send a reminder to the user or send queries to the user to determine whether the user still intends to honor the reservation. Where the user elects to give up the reservation, the space may be made available to other users and the map updated accordingly. In some instances a refund or partial refund may be given where a reservation is properly canceled.

Figure 7:
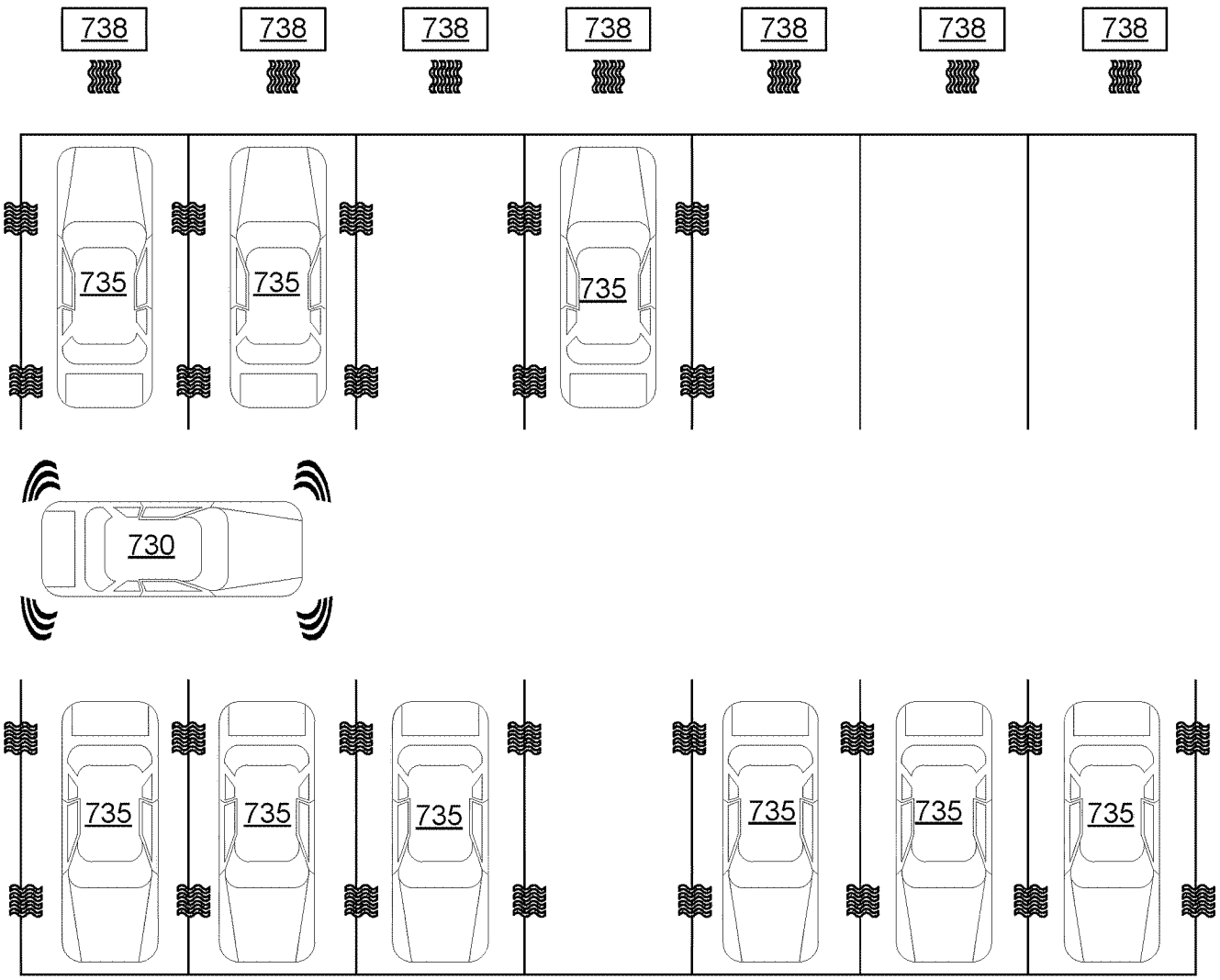
FIG. 7 illustrates an example scenario where user in a parking facility is looking for an open parking space in accordance with one embodiment.

FIG. 7 illustrates an example scenario where user in a parking facility is looking for an open parking space in accordance with one embodiment. In this example a user is operating vehicle 730 to look for an available parking space within the parking facility. Parked vehicle 735 are occupying a number of spots. However, this example illustrates 5 open spots. In this example, vehicle 730 includes proximity sensors and a camera to detect open parking spots. For example, front, rear and side infrared, lidar, radar or other proximity sensors can be used to detect the presence of vehicles and determine the absence of vehicles in particular spots. The camera can use image analysis techniques to also identify open spots based on the absence or presence of vehicles or based on lines in the parking lot.

Vehicles 735 can also include front, rear and side proximity sensors to sense the distance to surrounding objects. In the illustrated example, site sensors are used to determine the distance between a given vehicle and vehicles or walls or other obstacles adjacent to that vehicle. These sensors can be used to gather information relevant to determining parking space parameters. Vehicles 735 may also be equipped with cameras and other sensors to provide useful information. Although vehicles 735 are depicted as parked vehicles, in various applications vehicle 735 can also be used as active vehicles searching for parking spaces. In other words, vehicles equipped for parking facilitation can be equipped to function as active and passive vehicles.

This example also includes parking lot sensors 738 as infrastructure element sensors. In this example, sensors 738 are proximity sensors used to detect the absence or presence of vehicles in the various parking spaces. Image sensors, metal detectors, or other sensors can be used to detect the presence or absence of vehicles. To avoid unnecessary clutter in the drawing, sensors 738 are only illustrated at the top row of parking spaces. In various applications, sensors 738 can be provided for every parking space.

Figure 8:
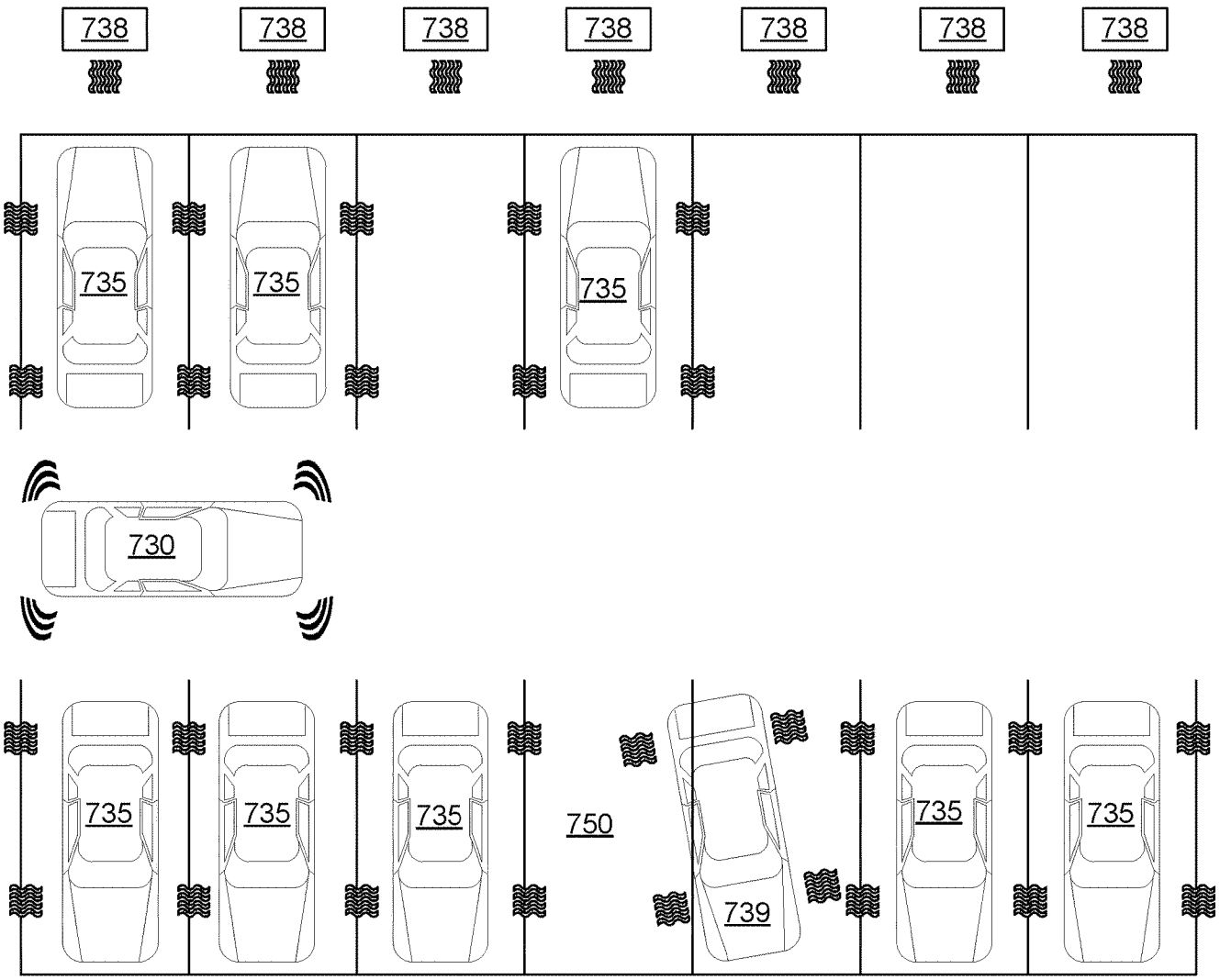
FIG. 8 illustrates another example of a parking scenario in accordance with one embodiment.

FIG. 8 illustrates another example of a parking scenario in accordance with one embodiment. In this example, vehicle 739 parked in such a manner so as to take up not only its own parking space but also part of the adjacent parking space 750. Proximity sensors on vehicle 739 and vehicle 735 immediately adjacent to space 750 can be used to show the reduced with available for parking space 750. This information can be used to update the parking space parameters for parking space 750. This information might also be gathered by image sensors on vehicles 735, 739 and 730 or by an image sensor at the infrastructure element.

Figure 9:
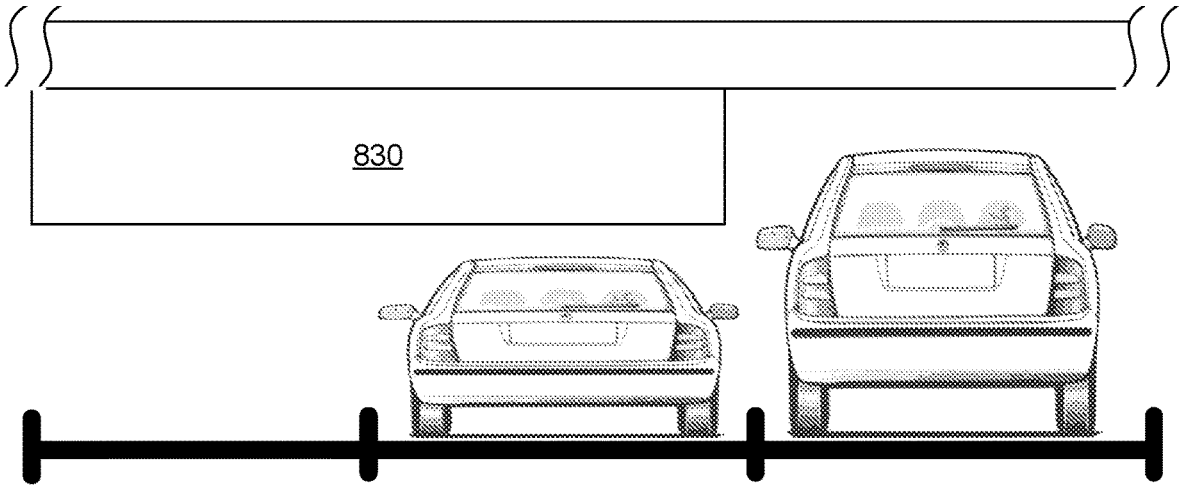
FIG. 9 illustrates another example of a parking space restriction in accordance with one embodiment.

FIG. 9 illustrates another example of a parking space restriction in accordance with one embodiment. In this example, a parking space parameter can be updated to show a height restriction for a particular parking space. For example, a vent, sprinkler line, cable chase or other structure 830 may be blocking the height of part or all of the parking space. Again, image sensors, proximity sensors, or other vehicle or infrastructure sensors may be used to provide information to detect this height restriction. Where the height restriction is permanent, such as a permanent event in a parking garage, this information can be stored for future recall such as, for example, in database 510. Where a user is operating a tall vehicle such as a lifted pickup truck or a tall SUV that would not fit into this parking space, the system may be configured to filter out this parking space so it is not shown as an available option to that user.

Figure 10:
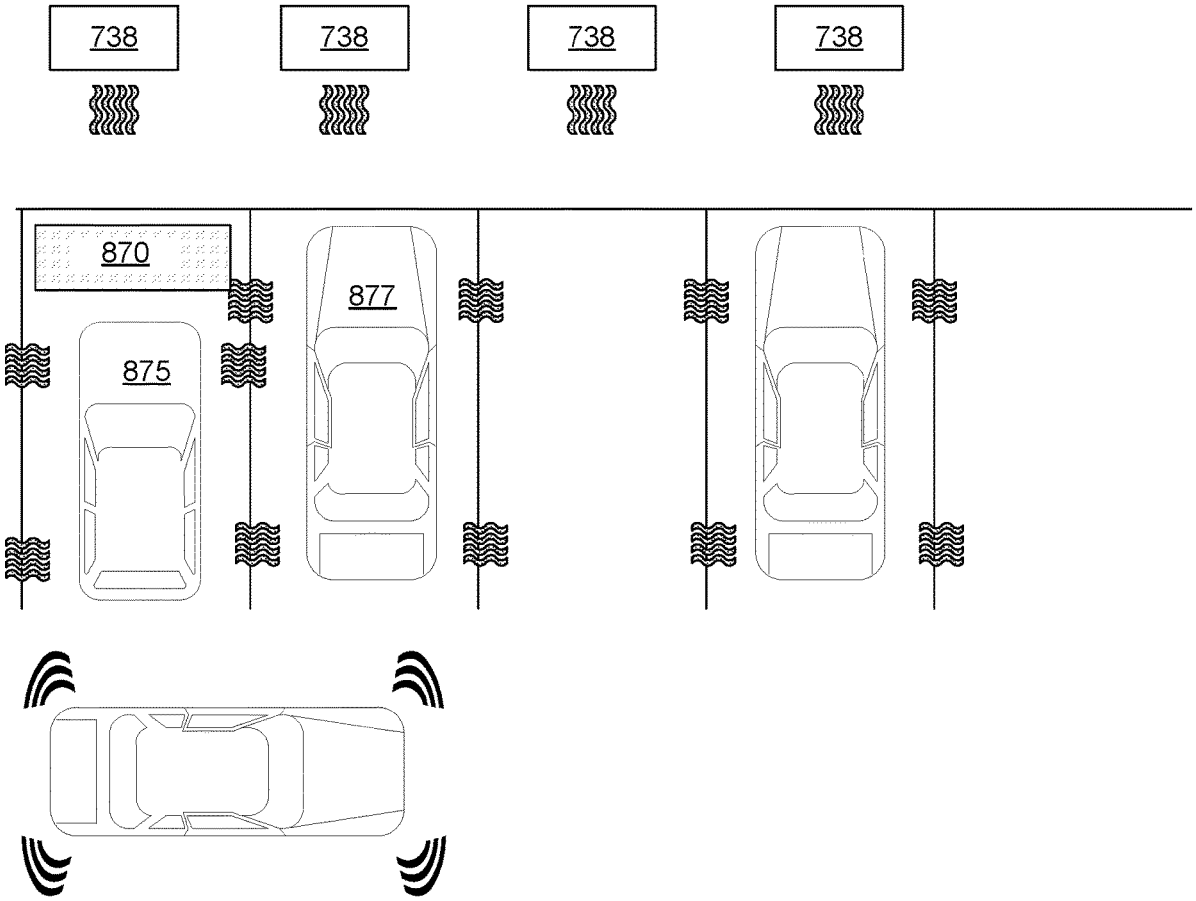
FIG. 10 illustrates yet another example of a parking space restriction in accordance with one embodiment.

FIG. 10 illustrates yet another example of a parking space restriction in accordance with one embodiment. In this example, a length restriction is present. For example, a ventilation system, storage area or other blockage may be present limiting the length of the available parking space. This is illustrated by element 870. Again, image sensors, proximity sensors, or other vehicle or infrastructure sensors may be used to provide information to detect this length restriction. For example, front sensors of vehicle 875 may detect the restriction. Likewise site sensors of adjacent vehicle 877 might also detect the obstruction. In further embodiments, permanent or built-in length, height or with restrictions can be programmed into the system such as in infrastructure elements that report information about the spaces of a particular parking facility so that the system need not rely on sensor information.

Where the length restriction is permanent, such as a permanent event in a parking garage, this information can be stored for future recall such as, for example, in database 510. Where a user is operating a long vehicle such as full-size sedan or large SUV that would not fit into this parking space, the system may be configured to filter out this parking space so it is not shown as an available option to that user.

Where parking is tight, the system may be configured to steer users of smaller vehicles or otherwise incentivize users of smaller vehicles to take smaller, less useful, spots so that larger or unrestricted spots may be available for larger vehicles. For example, pricing incentives, rewards or loyalty incentives, or other incentives may be applied to users of small vehicles to encourage them to take a less than desirable spot. As another example, the system may be configured to only show smaller spots to users of smaller vehicles. Through these and other like techniques, a parking facility can be managed to improve or even maximize utilization.

Figure 11:
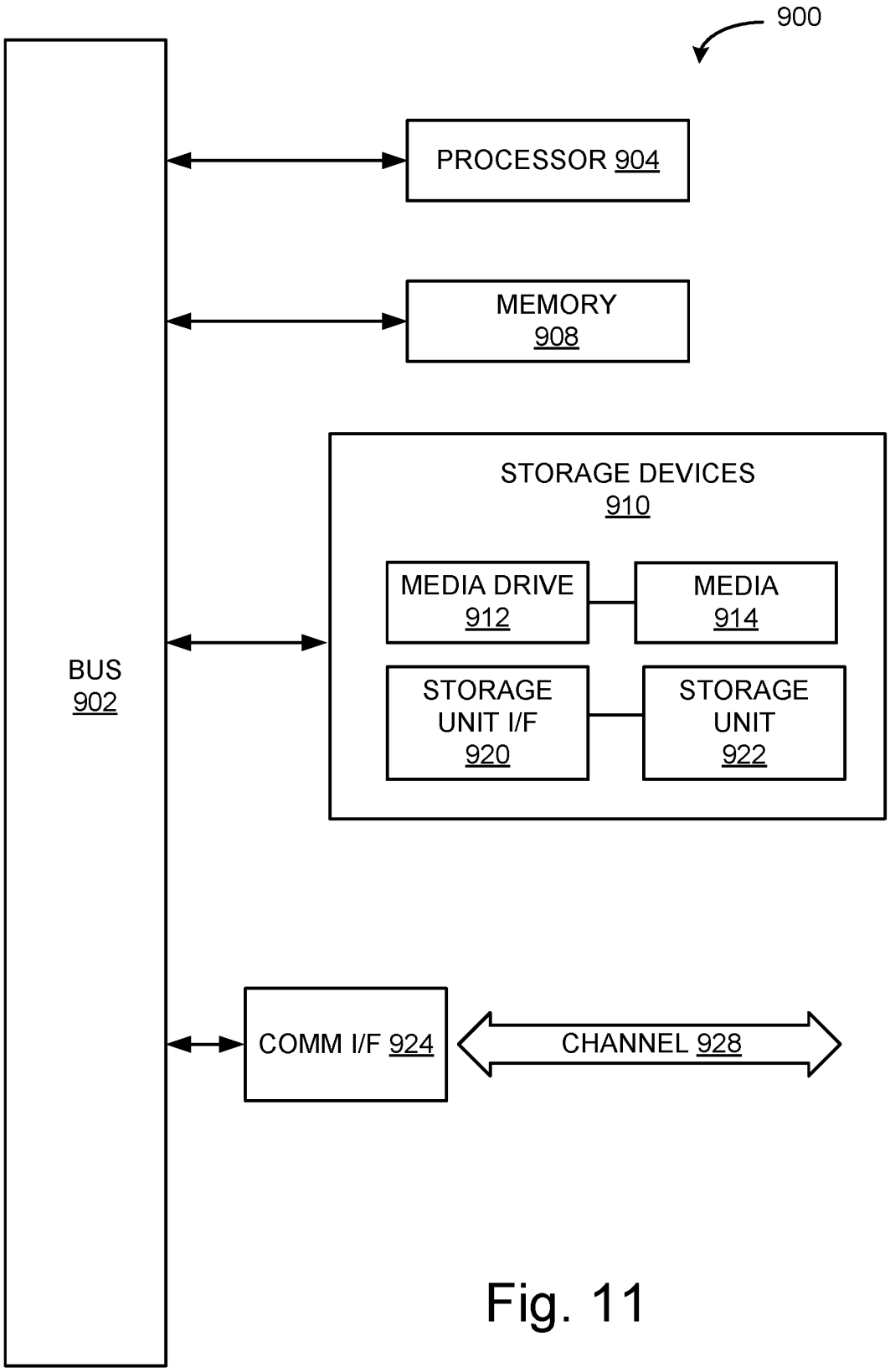
FIG. 11 is an example computing component that may be used to implement various features of embodiments described in the present disclosure.

As used herein, the terms circuit and component might describe a given unit of functionality that can be performed in accordance with one or more embodiments of the present application. As used herein, a component might be implemented utilizing any form of hardware, software, or a combination thereof. For example, one or more processors, controllers, ASICs, PLAs, PALs, CPLDs, FPGAs, logical components, software routines or other mechanisms might be implemented to make up a component. Various components described herein may be implemented as discrete components or described functions and features can be shared in part or in total among one or more components. In other words, as would be apparent to one of ordinary skill in the art after reading this description, the various features and functionality described herein may be implemented in any given application. They can be implemented in one or more separate or shared components in various combinations and permutations. Although various features or functional elements may be individually described or claimed as separate components, it should be understood that these features/functionality can be shared among one or more common software and hardware elements. Such a description shall not require or imply that separate hardware or software components are used to implement such features or functionality.

Where components are implemented in whole or in part using software, these software elements can be implemented to operate with a computing or processing component capable of carrying out the functionality described with respect thereto. One such example computing component is shown in FIG. 11. Various embodiments are described in terms of this example-computing component 500. After reading this description, it will become apparent to a person skilled in the relevant art how to implement the application using other computing components or architectures.

Referring now to FIG. 11, computing component 900 may represent, for example, computing or processing capabilities found within a self-adjusting display, desktop, laptop, notebook, and tablet computers. They may be found in hand-held computing devices (tablets, PDA's, smart phones, cell phones, palmtops, etc.). They may be found in workstations or other devices with displays, servers, or any other type of special-purpose or general-purpose computing devices as may be desirable or appropriate for a given application or environment. Computing component 900 might also represent computing capabilities embedded within or otherwise available to a given device. For example, a computing component might be found in other electronic devices such as, for example, portable computing devices, and other electronic devices that might include some form of processing capability.

Computing component 900 might include, for example, one or more processors, controllers, control components, or other processing devices. Processor 904 might be implemented using a general-purpose or special-purpose processing engine such as, for example, a microprocessor, controller, or other control logic. Processor 904 may be connected to a bus 902. However, any communication medium can be used to facilitate interaction with other components of computing component 900 or to communicate externally.

Computing component 900 might also include one or more memory components, simply referred to herein as main memory 908. For example, random access memory (RAM) or other dynamic memory, might be used for storing information and instructions to be executed by processor 904. Main memory 908 might also be used for storing temporary variables or other intermediate information during execution of instructions to be executed by processor 904. Computing component 900 might likewise include a read only memory ("ROM") or other static storage device coupled to bus 902 for storing static information and instructions for processor 904.

The computing component 900 might also include one or more various forms of information storage mechanism 910, which might include, for example, a media drive 912 and a storage unit interface 920. The media drive 912 might include a drive or other mechanism to support fixed or removable storage media 914. For example, a hard disk drive, a solid-state drive, a magnetic tape drive, an optical drive, a compact disc (CD) or digital video disc (DVD) drive (R or RW), or other removable or fixed media drive might be provided. Storage media 914 might include, for example, a hard disk, an integrated circuit assembly, magnetic tape, cartridge, optical disk, a CD or DVD. Storage media 914 may be any other fixed or removable medium that is read by, written to or accessed by media drive 912. As these examples illustrate, the storage media 914 can include a computer usable storage medium having stored therein computer software or data.

In alternative embodiments, information storage mechanism 910 might include other similar instrumentalities for allowing computer programs or other instructions or data to be loaded into computing component 900. Such instrumentalities might include, for example, a fixed or removable storage unit 922 and an interface 920. Examples of such storage units 922 and interfaces 920 can include a program cartridge and cartridge interface, a removable memory (for example, a flash memory or other removable memory component) and memory slot. Other examples may include a PCMCIA slot and card, and other fixed or removable storage units 922 and interfaces 920 that allow software and data to be transferred from storage unit 922 to computing component 900.

Computing component 900 might also include a communications interface 924. Communications interface 924 might be used to allow software and data to be transferred between computing component 900 and external devices. Examples of communications interface 924 might include a modem or softmodem, a network interface (such as Ethernet, network interface card, IEEE 802.XX or other interface). Other examples include a communications port (such as for example, a USB port, IR port, RS232 port Bluetooth® interface, or other port), or other communications interface. Software/data transferred via communications interface 924 may be carried on signals, which can be electronic, electromagnetic (which includes optical) or other signals capable of being exchanged by a given communications interface 924. These signals might be provided to communications interface 924 via a channel 928. Channel 928 might carry signals and might be implemented using a wired or wireless communication medium. Some examples of a channel might include a phone line, a cellular link, an RF link, an optical link, a network interface, a local or wide area network, and other wired or wireless communications channels.

In this document, the terms "computer program medium" and "computer usable medium" are used to generally refer to transitory or non-transitory media. Such media may be, e.g., memory 908, storage unit 920, media 914, and channel 928. These and other various forms of computer program media or computer usable media may be involved in carrying one or more sequences of one or more instructions to a processing device for execution. Such instructions embodied on the medium, are generally referred to as "computer program code" or a "computer program product" (which may be grouped in the form of computer programs or other groupings). When executed, such instructions might enable the computing component 900 to perform features or functions of the present application as discussed herein.

It should be understood that the various features, aspects and functionality described in one or more of the individual embodiments are not limited in their applicability to the particular embodiment with which they are described. Instead, they can be applied, alone or in various combinations, to one or more other embodiments, whether or not such embodiments are described and whether or not such features are presented as being a part of a described embodiment. Thus, the breadth and scope of the present application should not be limited by any of the above-described exemplary embodiments.

Terms and phrases used in this document, and variations thereof, unless otherwise expressly stated, should be construed as open ended as opposed to limiting. As examples of the foregoing, the term "including" should be read as meaning "including, without limitation" or the like. The term "example" is used to provide exemplary instances of the item in discussion, not an exhaustive or limiting list thereof. The terms "a" or "an" should be read as meaning "at least one," "one or more" or the like; and adjectives such as "conventional," "traditional," "normal," "standard," "known." Terms of similar meaning should not be construed as limiting the item described to a given time period or to an item available as of a given time. Instead, they should be read to encompass conventional, traditional, normal, or standard technologies that may be available or known now or at any time in the future. Where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases may be absent. The use of the term "component" does not imply that the aspects or functionality described or claimed as part of the component are all configured in a common package. Indeed, any or all of the various aspects of a component, whether control logic or other components, can be combined in a single package or separately maintained and can further be distributed in multiple groupings or packages or across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives can be implemented without confinement to the illustrated examples. For example, block diagrams and their accompanying description should not be construed as mandating a particular architecture or configuration.

What is claimed is:

1. A parking assistance system, comprising:

a communication interface to receive sensor information from a plurality of sensors;

an availability determination circuit to use the sensor information to determine one or more available parking spaces from among the plurality of potential parking spaces;

a parameter determination circuit to determine parking space parameters corresponding to the available parking spaces, to use information from a sensor to determine the presence of an obstruction rendering an available parking space at least partially obstructed, and to include information regarding the obstruction to the determined parking space parameters for the at least partially obstructed available parking spot;

a comparison circuit to compare vehicle profile information for a given vehicle to the parking space parameters, including the obstruction information, to identify one or more available parking spaces compatible with the given vehicle;

a parking space mapping circuit to generate a parking space map of identified compatible available parking spaces to the given vehicle that can be provided to the given vehicle;

a communication circuit to receive a parking space reservation identifying a parking space selected for reservation by a user of the given vehicle from one or more of the identified compatible available parking spaces on the parking space map, the parking space reservation received from the user of the given vehicle in advance of the given vehicle's arrival at the parking space; and based on the parking space reservation, the parking assistance system updating parking space availability data to reflect unavailability of the parking space selected for reservation by the user.

2. The system of claim 1, wherein the parking assistance system comprises a parking facilitation circuit in a vehicle.

3. The system of claim 1, wherein the parking assistance system comprises a parking facilitation circuit in a cloud environment.

4. The system of claim 1, wherein the plurality of sensors comprise at least one of sensors in an active vehicle, sensors in a passive vehicle and sensors of infrastructure elements.

5. The system of claim 1, wherein the plurality of sensors comprise at least one of an image sensor and a proximity sensor.

6. The system of claim 1, wherein the parking assistance system further comprises a plurality of sensors in an active vehicle and a plurality of sensors and a plurality of sensors in passive vehicles, the sensors gathering information about potential parking spaces.

7. A method of collaborative parking assistance using a parking facilitation circuit, the method comprising:

using information from a plurality of sensors to locate one or more available parking spaces in a determined area;

using information from a sensor to determine the presence of an obstruction rendering an available parking space at least partially obstructed;

characterize the located available parking spaces to generate parking space parameters for each of the available parking spaces, wherein the parking space parameters for an obstructed parking spot comprise information regarding the obstruction;

generating a parking space map comprising an indication of available parking spaces, locations of the available parking spaces and parking space parameters for the available parking spaces;

filtering the parking space map to include as available parking spaces only those one or more available parking spaces that, based on the parking space parameters, are compatible with a vehicle intended to park in the determined area;

providing the filtered parking space map to a user interface of the vehicle for viewing by an occupant of the vehicle;

receiving a parking space reservation identifying a parking space selected for reservation by the occupant of the vehicle from the compatible available parking spaces on the filtered parking space map, the parking space reservation received from the occupant of the vehicle in advance of the vehicle's arrival at the parking space selected for reservation; and based on the parking space reservation, updating the filtered parking space map to reflect unavailability of the parking space selected for reservation by the occupant of the vehicle.

8. The method of claim 7, wherein filtering comprises:

obtaining a profile for each of one or more vehicles wherein each profile includes specification data for each vehicle; and comparing the profile for each of the one or more vehicles against the parking space parameters for available parking spaces to identify one or more compatible parking spaces for the vehicle.

9. The method of claim 7, wherein:

filtering further comprises obtaining a profile for a plurality of vehicles intended to be parked in the determined area, wherein each profile includes specification data for its corresponding vehicle; and comparing the profile for each of the plurality of vehicles against the parking space parameters for available parking spaces in the determined area to identify one or more parking spaces compatible with one or more of the plurality of vehicles intended to be parked in the determined area; and wherein providing further comprises transmitting the filtered parking space map to the plurality of vehicles.

10. The method of claim 7, wherein the parking space map is generated outside of the vehicle and transmitted to the vehicle by from an infrastructure element or from another vehicle.

11. The method of claim 7, wherein the plurality of sensors comprise at least one of sensors in an active vehicle, sensors in a passive vehicle and sensors of infrastructure elements.

12. The method of claim 7, further comprising the user interface displaying the parking space map to a user of the vehicle.

13. The method of claim 12, further comprising the user interface accepting a user input of a selected parking space and providing the selection to a navigation system of the vehicle so that the navigation system can generate instructions to navigate the vehicle to the selected parking space.

14. The method of claim 7, wherein parking space parameters comprise at least one of length, width, and height of a parking space.

15. The method of claim 14, wherein parking space parameters for a first parking space are determined by taking measurements from proximity sensors of vehicles parked adjacent to the first parking space.

16. The method of claim 7, wherein parking space availability is determined using sensor information from a sensor of at least one of an active vehicle, a passive vehicle and an infrastructure element.

17. The method of claim 7, wherein the determined area is at least one of a geographic area, a geofenced area, a venue, a vicinity around a vehicle, a vicinity around a destination, and a parking facility.

18. The system of claim 1, further comprising the parking assistance system collecting payment for the parking space selected for reservation upon receiving the reservation from the user.

19. The system of claim 1, wherein updating parking space availability data to reflect unavailability of the identified parking space selected for reservation comprises updating the parking space selected for reservation as unavailable at the time the reservation is received.

20. The system of claim 1, wherein the parking space reservation further comprises a period of time for the reservation, and updating the parking space availability data to reflect unavailability of the parking space comprises reflecting unavailability of the parking space only for those times during which the parking space is reserved.

21. The system of claim 1, further comprising a vehicle identifier for the vehicle used by the parking assistance system to confirm that the given vehicle is permitted to park in the parking space selected for reservation.

22. The system of claim 1, further comprising an electronic sign to indicate a state of reservation of a parking space corresponding to the sign and wherein the parking assistance system updates a display of the sign based on reservation states of a parking space corresponding to the sign.

23. The method of claim 7, further comprising collecting payment for the parking space selected for reservation upon receiving the reservation from the occupant of the vehicle.

24. The method of claim 7, wherein updating the filtered parking space map to reflect unavailability of the identified parking space selected for reservation comprises updating the filtered parking space map at the time the reservation is received.

25. The method of claim 7, wherein the parking space reservation further comprises a period of time for the reservation, and updating the filtered parking space map to reflect unavailability of the parking space comprises reflecting unavailability of the parking space only for the period of time for the reservation.

26. The method of claim 7, further comprising using a vehicle identifier for the vehicle to confirm that the vehicle is permitted to park in the parking space selected for reservation.

27. The method of claim 7, further comprising using an electronic sign to indicate a state of reservation of a parking space corresponding to the sign and wherein a display of the sign is updated based on reservation states of a parking space corresponding to the sign.

28. The system of claim 1, wherein the sensor providing information to determine the presence of an obstruction comprises a sensor of a vehicle adjacent the at least partially obstructed parking spot.

29. The system of claim 1, wherein the communication circuit is further configured to provide an incentive to users of vehicles dimensioned to fit into the at least partially obstructed parking spot to take the at least partially obstructed parking spot.

30. The system of claim 29, wherein the incentive comprises at least one of a pricing incentive, reward or loyalty incentive.

31. The system of claim 29, wherein the parking space mapping circuit is further configured to include only one or more at least partially obstructed parking spots in a parking space map provided to a vehicle that is dimensioned to fit into the one or more at least partially obstructed parking spots.

32. The system of claim 1, wherein the obstruction rendering the available parking space at least partially obstructed comprises a vehicle parked adjacent the at least partially obstructed available parking spot in a manner that encroaches upon the at least partially obstructed available parking spot.

33. The method of claim 7, wherein the information from the sensor providing information to determine the presence of an obstruction comprises information from a sensor of a vehicle adjacent the at least partially obstructed parking spot.

34. The method of claim 7, further comprising providing an incentive to users of vehicles dimensioned to fit into the at least partially obstructed parking spot to take the at least partially obstructed parking spot.

35. The method of claim 29, wherein the incentive comprises at least one of a pricing incentive, reward or loyalty incentive.

36. The method of claim 34, wherein the parking space map provided to a vehicle that is dimensioned to fit into one or more at least partially obstructed parking spots includes only those at least partially obstructed parking spots into which that vehicle will fit.

37. The system of claim 7, wherein the obstruction rendering the available parking space at least partially obstructed comprises a vehicle parked adjacent the at least partially obstructed available parking spot in a manner that encroaches upon the at least partially obstructed available parking spot.

* * * * *